US005544818A

United States Patent [19]

Yoshida et al.

[11] Patent Number: 5,544,818

[45] Date of Patent: Aug. 13, 1996

[54] PULVERIZING METHOD AND HORIZONTAL MILL

[75] Inventors: Hirohisa Yoshida; Katsuyuki Ueda, both of Nagasaki, Japan

[73] Assignee: Mitsubishi Jukogyo Kabushiki Kaisha, Tokyo, Japan

[21] Appl. No.: 505,636

[22] Filed: Jul. 21, 1995

[30] Foreign Application Priority Data

Sep. 28, 1994 [JP] Japan ..... 6-232994

[51] Int. Cl.[6] ..... B02C 17/00; B02C 17/18

[52] U.S. Cl. ..... 241/29; 241/174; 241/179

[58] Field of Search ..... 241/172, 173, 241/174, 29, 179

[56] References Cited

U.S. PATENT DOCUMENTS

| | | | |
|---|---|---|---|
| 3,202,364 | 8/1965 | Wieland . | |
| 4,174,074 | 11/1979 | Geiger | 241/172 X |
| 4,206,879 | 6/1980 | Geiger | 241/172 X |
| 4,651,935 | 3/1987 | Samosky et al. | 241/65 |
| 5,246,173 | 9/1993 | Steidl | 241/30 |
| 5,312,055 | 5/1994 | Barthelmess et al. | 241/172 |
| 5,379,952 | 1/1995 | Geiger | 241/65 |

FOREIGN PATENT DOCUMENTS

| | | | |
|---|---|---|---|
| 0219740 | 4/1987 | European Pat. Off. . | |
| 0476189 | 3/1992 | European Pat. Off. . | |
| 2510908 | 2/1983 | France . | |
| 2047244 | 3/1981 | Germany | 241/172 |

*Primary Examiner*—John Husar
*Attorney, Agent, or Firm*—Wenderoth, Lind & Ponack

[57] ABSTRACT

A horizontal mill for ultra-fine pulverization which has enhanced pulverization characteristics and reduced power consumption while suppressing damage or wear of pulverizing media. The pulverizing media (balls) are provided in a pulverizing chamber defined by a space between an inner cylinder and an outer cylinder which are rotated relative to each other. Large diameter pulverizing media are used and the rotational speed is kept at a low level, which is opposite to the conventional theory of using small diameter media and high rotational speeds. Since the rotational speed is low, the corresponding wear of the pulverizing media is reduced. The degradation in pulverizing performance due to the low rotational speed may be recovered by using large diameter pulverizing media. Also, the dimensional ratio between the inner and outer cylinders, the interval between the inner and outer sleeves, and the axial interval between agitating vanes are suitably selected to enhance the mill performance.

2 Claims, 11 Drawing Sheets

PULVERIZING METHOD AND HORIZONTAL MILL

BACKGROUND OF THE INVENTION

The present invention relates to an ultra-fine pulverizing method for obtaining ultra fine particles having a size of several microns or less, which are needed in a high strength concrete, a high performance catalyst or the like.

A recent technology is disclosed in Japanese Pat. Examined Publication No. Hei 5-87307 entitled "Centrifugal Processing Method and Apparatus". The concept of that technology is a vertical mill, as shown in FIG. 15, in which an agitating shaft 02 is provided within a hollow rotor 01 and pulverizing media 03 are disposed in a gap S between the shaft 02 and the rotor 01. Then, under the condition that the material M to be processed is present in the gap S, the hollow rotor 01 is rotated and at the same time, the agitating shaft 02 is rotated in the opposite direction to that of the rotor 01, thereby pulverizing the material M to be processed. According to the publication, the rotational speed is adjusted so that an acceleration exceeding 1 G is applied to the pulverizing media 03, and it is preferable to select the rotational speed in the range of 10 G to 200 G.

Also, according to the publication, it is preferable that when an inner radius of the hollow rotor 01 is represented by R, the above-described gap S meets the relation, $0.50 \leqq S/R \leqq 0.95$, more preferably S/R=0.80 to 0.95. Namely, in the case where the gap S is small (S/R<0.50), the centrifugal force is made-uniform and the pulverizing effect is made uniform but the processing performance degrades. On the other hand, in the case where S/R>0.95, the agitating effect attained by the agitating shaft 02 degrades.

Conventionally, there is a theory prerequisite that "it is preferable to use a high rotational speed and small size pulverizing media". Therefore, the conditional theory suggests high speed rotation of 10 G to 200 G as mentioned above and pulverizing media having a small diameter of 3 mm or less.

However, this high rotational speed and small diameter media type mill suffers from the following problems.

(1) Frictional wear of the pulverizing media is large.

Since the frictional wear rate of the pulverizing media is in proportion to a rotational speed of the mill and a specific surface area of the pulverizing media, the more the acceleration and the smaller the pulverizing media, the more the frictional wear rate will increase as shown in FIG. 5.

(2) Damage rate of the pulverizing media is high.

The greater the diameter of the pulverizing media, the greater the pressure yield strength of the pulverizing media will become. Therefore, in case of the small diameter media, the damage rate of the pulverizing media is high.

(3) Power consumption is large and the temperature of the pulverizing material is high.

The mill power is in proportion to the rotational speed and the amount of heat generated in the mill is in proportion to the mill power. Accordingly, in case of the high rotational speed, the temperature of the pulverized material becomes high. In many cases, the elevated temperature is a factor in the degradation of the quality of the pulverized material or the hindrance against the upgrading the performance.

SUMMARY OF THE INVENTION

An object of the present invention is to enhance pulverizing characteristics and to reduce power consumption while suppressing damage/wear of pulverizing media in a horizontal mill for ultra-fine pulverization by using the pulverizing media (balls) and using a space between an inner clylinder or sleeve and an outer cylinder or sleeve which are rotated relative to each other as a pulverizing chamber.

In order to attain this and other objects, according to the present invention, there is provided a pulverizing method with a horizontal mill, in which pulverizing media are received in a space having an annular cross section between a substantially horizontal outer sleeve having an inner surface on which a plurality of agitating vanes are mounted and an inner sleeve having an outer surface on which a plurality of vanes are mounted. The inner sleeve is coaxial with the outer sleeve, and in which at least one of said outer and inner sleeves is rotated to pulverize a material to be fed into the space having the annular cross section. The pulverizing method is characterized in that:

(a) at least one of the inner sleeve and the outer sleeve is rotated at such a rotational speed that a maximum acceleration to be applied to the pulverizing media does not exceed three times of a gravitational acceleration.

(b) a diameter of the pulverizing media is in the range of 5 to 15 mm;

(c) an interval between the inner surface of the outer sleeve and the outer surface of the inner sleeve is not smaller than three times of a diameter of the pulverizing media;

(d ) an axial interval between the agitating vanes of each of the inner and outer sleeves is in the range of three to sixty times of the diameter of the pulverizing media; and (e) a ratio of an inner diameter of the outer sleeve to an outer diameter of the inner sleeve is not smaller than 0.5.

According to the method of the invention, it is possible to enjoy the following effects.

(a) Since at least one of the inner sleeve and the outer sleeve is rotated at such a rotational speed that a maximum acceleration to be applied to the pulverizing media does not exceed three times of the gravitational acceleration, the wear of the pulverizing media may be suppressed.

(b) Since the diameter of the pulverizing media is in the range of 5 to 15 mm, the degradation of the pulverizing force due to the low rotational speed may be recovered.

(c) Since the interval between the inner surface of the outer sleeve and the outer surface of said inner sleeve is not smaller than three times of a diameter of the pulverizing media, the driving failure (abnormally high power) caused by bridging of the pulverizing media may be prevented.

(d) Since the axial interval between the agitating vanes of each of the inner and outer sleeves is in the range of three to sixty times of the diameter of the pulverizing media, the bridge phenomenon of the pulverizing media and the pulverizing power transmission failure may be prevented.

(e) Since the ratio of an outer diameter of the inner sleeve to an inner diameter of the outer sleeve is not smaller than 0.5, the media filling weight is small at the same media filling rate and the power consumption may be reduced.

Also, in order to attain the above-described and other objects, according to another aspect of the invention, there is provided a horizontal mill including a substantially horizontal outer cylinder having an inner surface on which a plurality of agitating vanes are mounted.

An inner coaxial cylinder having an outer surface on which a plurality of agitating vanes are mounted is provided in the outer cylinder.

Pulverizing media are received in a space having a cross section in the form of an annulus between the outer sleeve and the inner sleeve; and means for rotating at least one of said outer sleeve and the inner sleeve, for pulverizing a material to be fed into the space having the annular cross section. The horizontal mill being characterized in that:

(a) a diameter of the pulverizing media is in the range of 5 to 15 mm;

(b) an interval between the inner surface of the outer sleeve and the outer surface of the inner sleeve is not smaller than three times of a diameter of the pulverizing media;

(c) an axial interval between the agitating vanes of each of the inner and outer sleeves is in the range of three to sixty times of the diameter of the pulverizing media; and (d) a ratio of an inner diameter of the outer sleeve to an outer diameter of the inner sleeve is not smaller than 0.5.

According to this mill, it is possible to effectively carry out the pulverizing method of the present invention.

DESCRIPTION OF THE PREFERRED EMBODIMENTS

The present invention will now be described with reference to the accompanying drawings.

Figure 1:
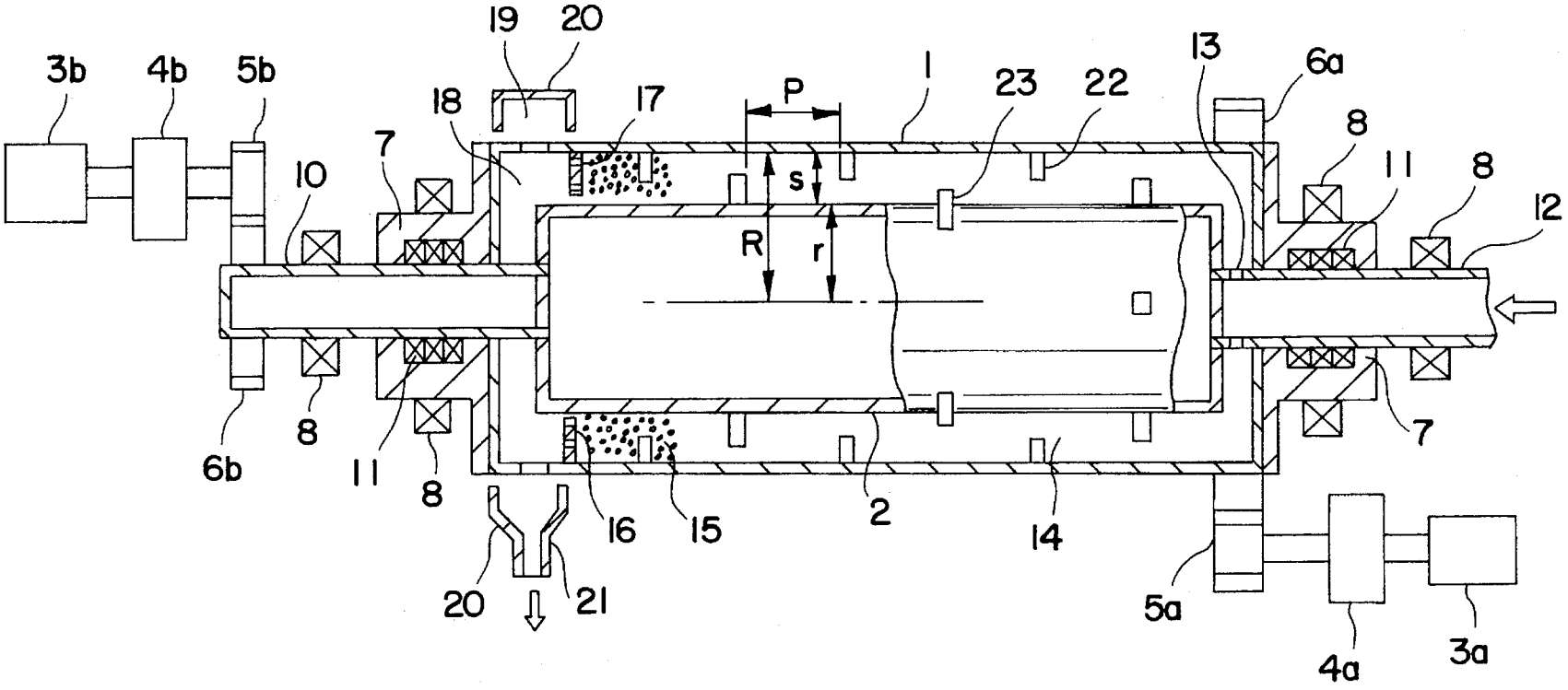
FIG. 1 is a longitudinal sectional view showing an example of a horizontal mill according to the present invention, for embodying a method of the invention.
Figure 2:
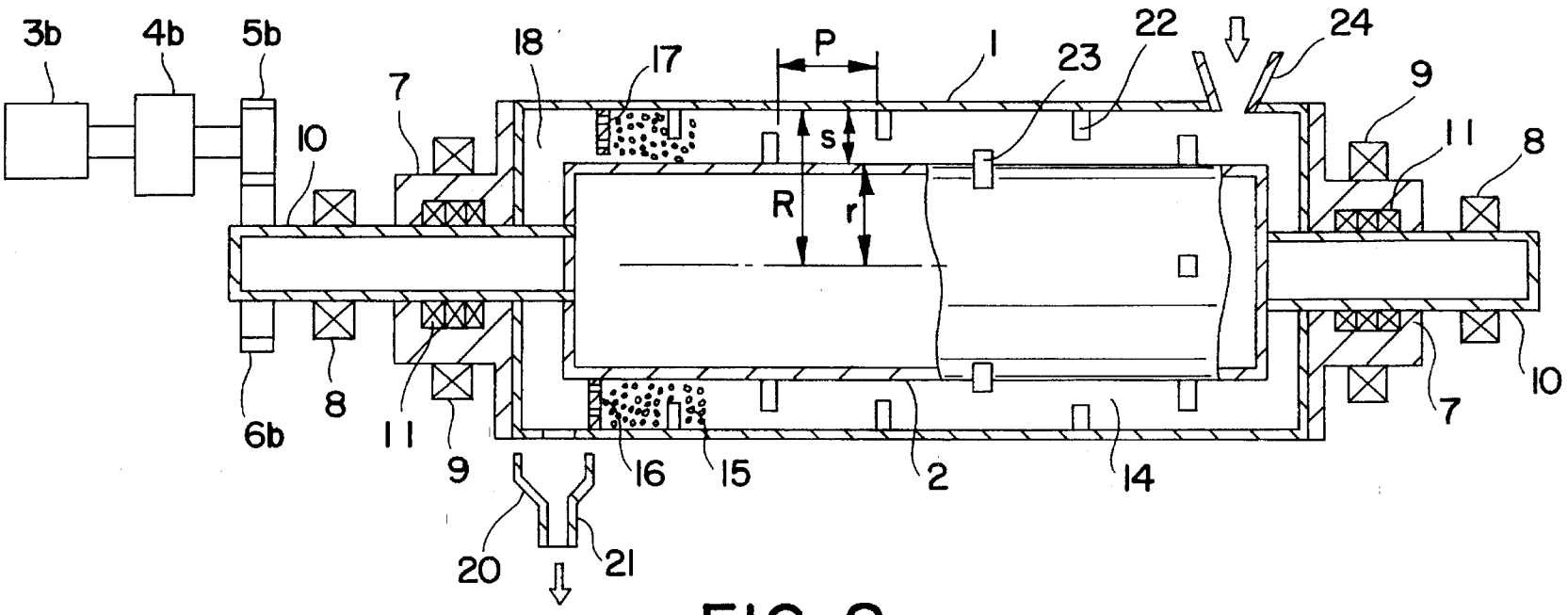
FIG. 2 is a longitudinal sectional view showing another example of a horizontal mill according to the present invention, for embodying a method of the invention.

In FIGS. 1 and 2 showing horizontal mills embodying a method of the present invention, reference numeral 1 denotes an outer sleeve, numeral 2 denotes an inner sleeve, reference characters 3*a* and 3*b* denote motors, characters 4*a* and 4*b* denote speed reducers, characters 5*a*, 5*b*, 6*a* and 6*b* denote gears, numeral 7 denotes flanges, numeral 8 denotes bearings, numeral 9 denotes fastening members, numeral 10 denotes a hollow rotary shaft, numeral 11 denotes grand packings, numeral 12 denotes a slurry feed pipe, numeral 13 denotes a slurry feed hole, numeral 14 denotes a pulverizing chamber, numeral 15 denotes a pulverizing medium, numeral 16 denotes a porous plate, numeral 17 denotes slits, numeral 18 denotes a reservoir chamber, numeral 19 denotes a discharge port, numeral 20 denotes a discharge guide plate, numeral 21 denotes a discharge pipe, numerals 22 and 23 denote agitating vanes, and numeral 24 denotes a pulverized material feed inlet. The mill shown in FIG. 1 is of a mutual rotational type in which the outer sleeve 1 and the inner sleeve 2 are rotated in opposite directions and the material to be pulverized is fed from the slurry feed pipe in the form of the slurry and is discharged from a discharge pipe 21. Also, the mill shown in FIG. 2 is of an inner sleeve independent rotational type in which the material to be pulverized is fed from the pulverized material feed inlet 24 in the form of powder and is discharged from the discharge pipe 21.

Acceleration and Size of Pulverizing Media

A pulverizing energy E of a single pulverizing medium having a diameter d, to be imparted to the pulverized material, is given as follows:

$$E \propto (\text{in proportion to}) \gamma \times d^3 \times v^2 \propto \gamma \times d^3 \times A$$

where $\gamma$ is the media density, v is the media rotational speed and A is the maximum acceleration.

Accordingly, in comparison with the case of d=10 mm and A=3 G and the case of d=3 mm and A=20 G, the ratio of the pulverized energy is $(10^3 \times 3)/(3^3 \times 20)=5.6$. A pulverizing method using a large diameter medium at a low rotational speed as in the method according to the present invention, may provide a much greater pulverizing energy than that in the conventional case of the small diameter media at the high rotational speed.

Figure 3:
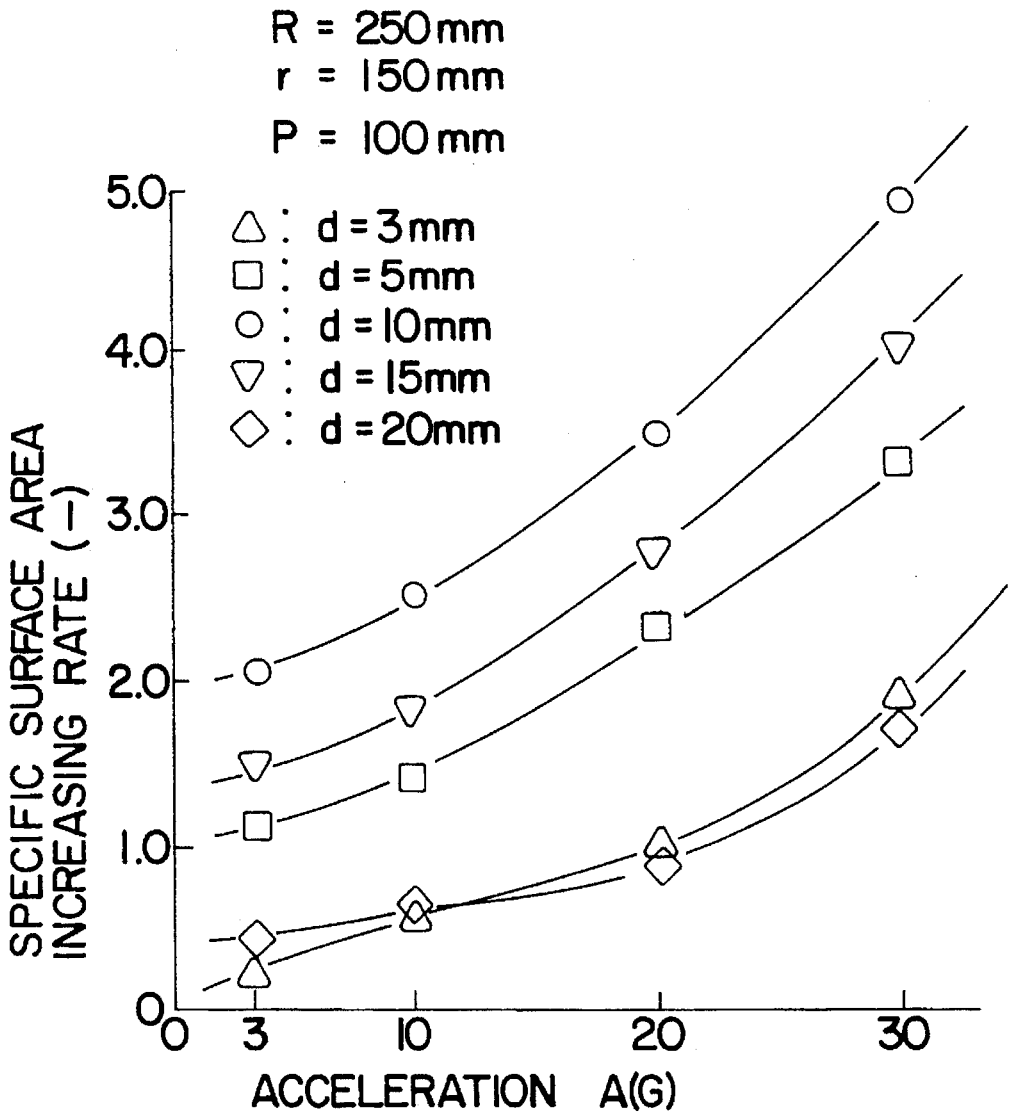
FIG. 3 is a graph of an experimental results showing the relationship between acceleration and pulverizing media diameter and pulverizing characteristics.

The pulverizing characteristics are shown in FIG. 3, in which the horizontal mills (the outer sleeve 1 having the inner radius R=250 mm kept constant) was used, and the silica stone pulverizing test was conducted by changing the acceleration A and the pulverizing media diameter d under the condition that the outer radius r of the inner sleeve 2 was 150 mm (S/R=0.4) and the vane pitch P is 100 mm. In FIG. 3, the pulverization characteristics of the conventional mill (comparison in terms of the specific surface area increasing rate) are shown as 1.0 when the diameter d is 3 mm and the acceleration A is 20 G. As is apparent from FIG. 3, if the large diameter medium of d=5 to 15 mm was used, the pulverization characteristics which were better than those in the case of d=3 mm and A=20 G could be obtained even at the low rotational speed of 3 G.

Figure 4:
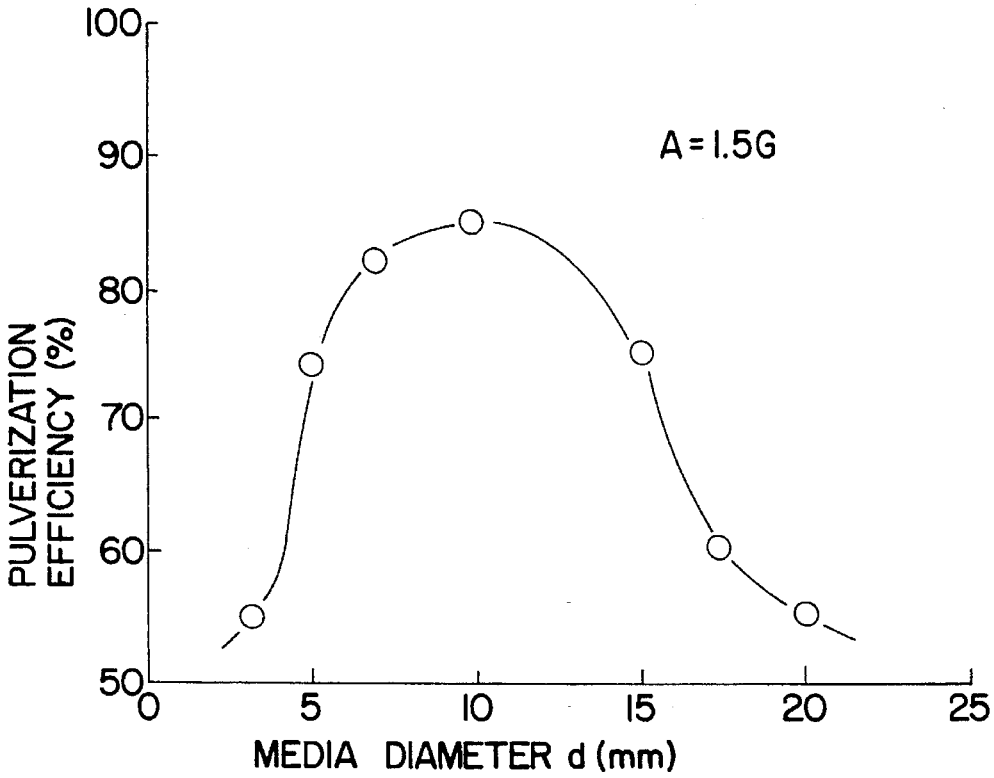
FIG. 4 is a graph of experimental results showing the relationship between the pulverizing media diameter and pulverization efficiency.

Also, in order to confirm the characteristics at the low rotational speed, the pulverizing test for FRP which was a kind of plastics was conducted under the condition A=1.5 G (constant). The result is shown in FIG. 4. FIG. 4 shows a relationship between the pulverizing efficiency (1μm or less when a constant energy was applied) and the pulverizing media diameter d. It is understood from the experimental result that it is possible to obtain high pulverizing characteristics by using the media having a large diameter of d=5 to 15 mm.

Figure 5:
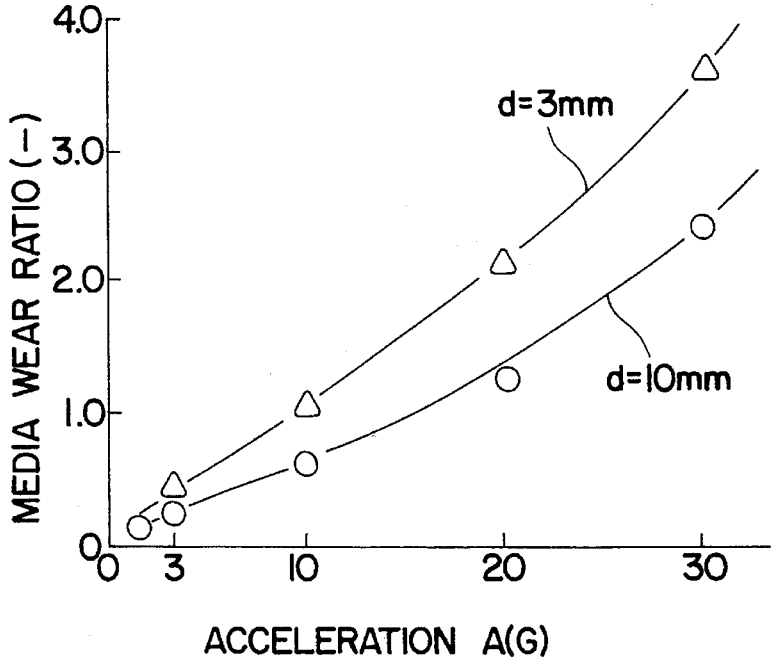
FIG. 5 is a graph of experimental results showing the relationship between acceleration, pulverizing media diameter, and wear status of the pulverizing media.

On the other hand, the frictional wear rate of the pulverizing media could be considerably reduced by using the low rotational speed. FIG. 5 shows the test result which compares the wear conditions of the pulverizing media when the silica stone had been pulverized continuously for 50 hours. The media wear rate of the ordinate represents the ratio of weights of the media before and after the test. As was apparent from this, when the large diameter media were used at the low rotational speed, the wear could be reduced. For example, in comparison with the case of the conventional mill (A=20 G and d=3 mm), the wear amount could be reduced to about one tenth in case of A=1.5 G and d=10 mm.

Interval between Inner and Outer Sleeves and Size of Pulverizing Media

Figure 6:
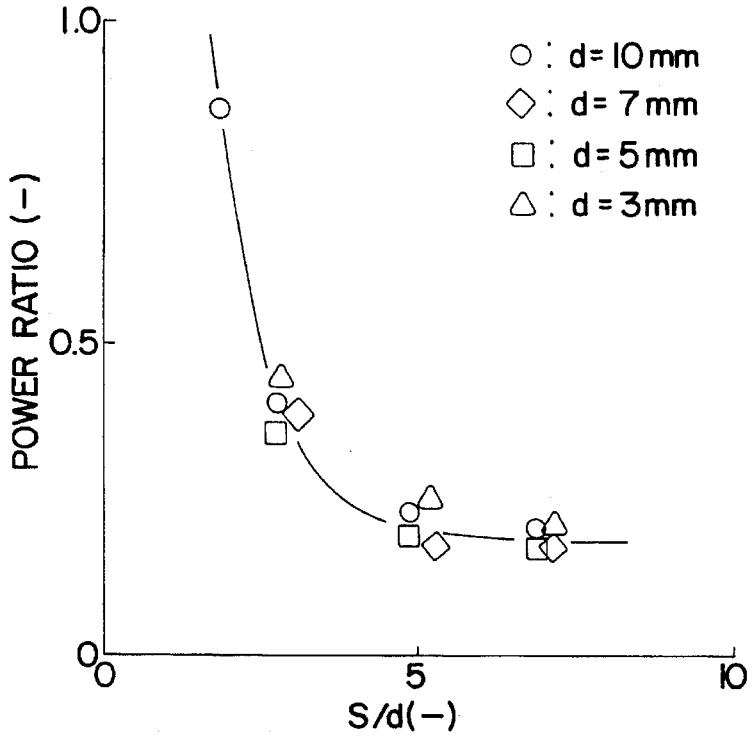
FIG. 6 is a graph of experimental results showing the relationship between an interval between an inner sleeve and an outer sleeve, size of the pulverizing media, and mill power.

When the gap S between the inner and outer sleeves was too small, a bridge phenomenon of the pulverizing media was generated and motion was prevented so that the power became abnormally high. As a result, the mill would be tripped or temporarily shut down. The present inventors have found from a number of tests that the relation shown in FIG. 6 was established between S/d, and the mill power and if the interval between the inner sleeve and the outer sleeve in which three media were interposed, i.e., S/D≧3 was established, there was no bridge phenomenon.

Axial Interval of Agitating Vanes and Size of Pulverizing Media

Figure 7:
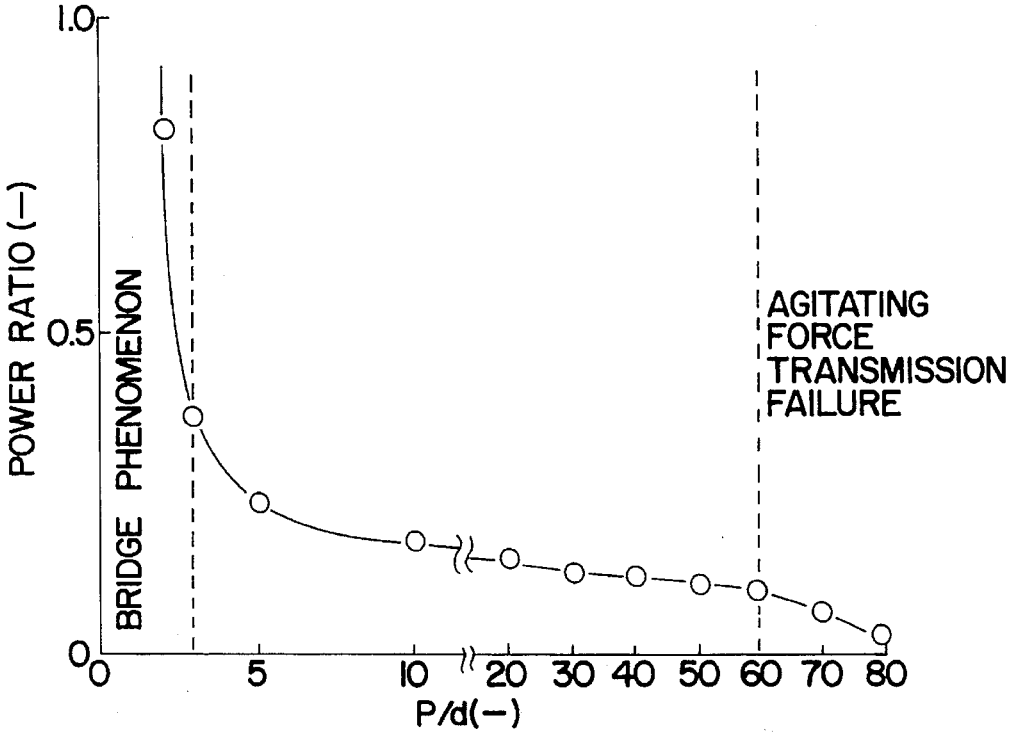
FIG. 7 is a graph of experimental results showing the relationship between an axial interval of the agitating vanes, size of the pulverizing media, and mill power.

In the horizontal mills embodying the present invention, a plurality of agitating vanes are provided on the inner surface of the outer sleeve and the outer surface of the inner sleeve. The axial interval (pitch) between the agitating vanes largely affects the pulverizing characteristics and the drivability of the mill. The present inventors have found from a number of tests that it was possible to classify the pitches P according to the ratio with the pulverizing media diameter d as shown in FIG. 7 and the optimum range was 3≦P/d≦60 in case of the large diameter media of 5 to 15 mm at the low rotational speed of 3 G or less. If P/d<3, the above-described bridge phenomenon of the pulverizing media was generated in the axial direction. Also, if P/d>60, the number of the pulverizing media interposed in one pitch interval was too large so that the agitating power would result in insufficient transmission and the pulverizing power would be insufficient resulting in degradation in pulverizing performance.

Dimensional Ratio of Inner and Outer Sleeves

Figure 8A:
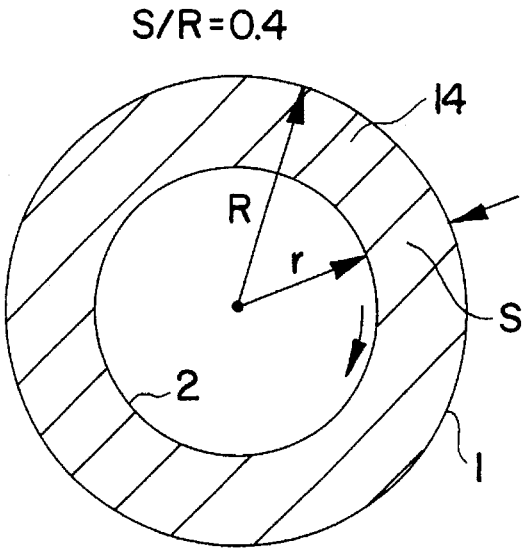
FIG. 8 is a view showing a relationship between a dimensional ratio of the inner and outer sleeves and volume of a pulverizing chamber.
Figure 8B:
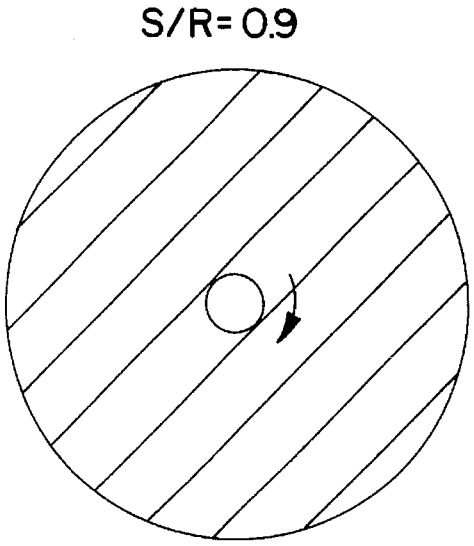
Figure 9:
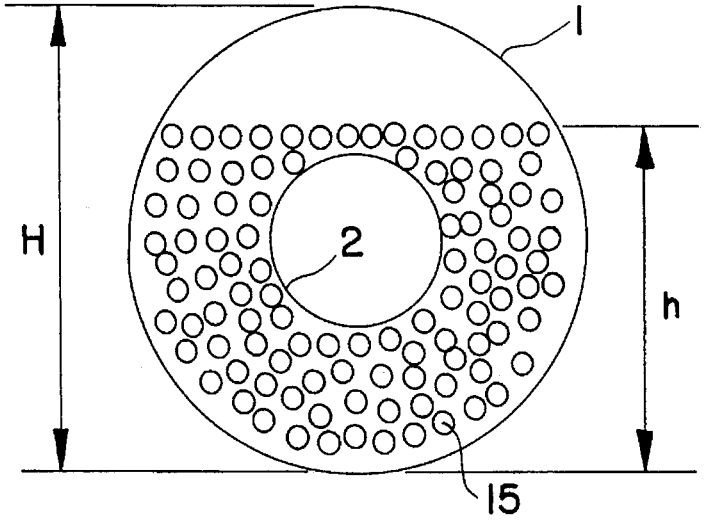
FIG. 9 is a view illustrating the media filling efficiency.

If the inner sleeve having the large outer diameter was used while the inner diameter of the outer sleeve was kept constant; that is, r/R was large and S/R was small, a volume of the pulverizing chamber 14 (hatched portion) in FIG. 8 was small. In this case, it was sufficient to use a small weight of the media in order to obtain the same media filling rate (media filling height h/pulverizing chamber height H) (see FIG. 9). Since the mill power consumption was increased in accordance with the increase of the media weight, there was a large effect with the small weight of the media. Also, the pulverization is effected at the outer annular portion where the maximum media rotational speed may be obtained and the pulverizing efficiency is enhanced as described later.

Figure 10A:
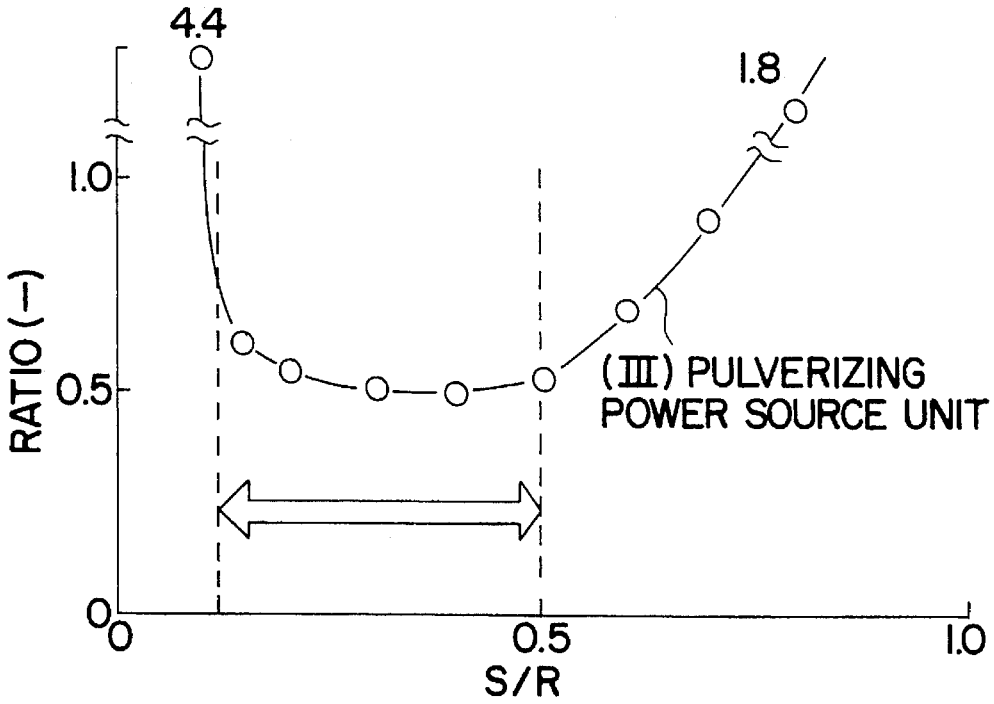
FIG. 10 is a graph of experimental results concerning a relationship between the dimensional ratio of the inner and outer sleeve, pulverizing media weight, mill power consumption and the pulverizing power source unit.
Figure 10B:
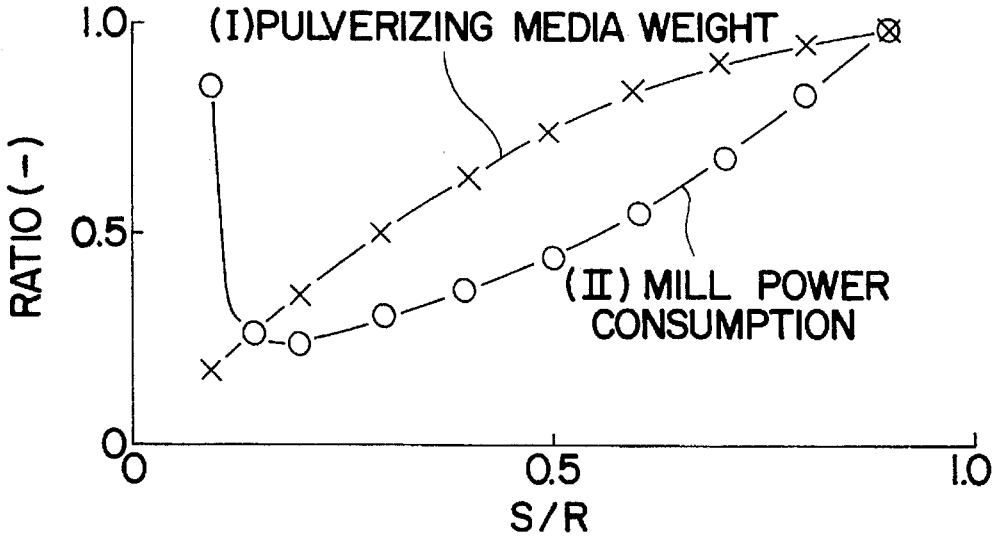

FIG. 10 shows the test result in which the ratio S/R was changed from 0.1 to 0.9 under the condition of the media filling rate of 85%, A=1.5 G and d=10 mm (any of which was kept constant). The curve I represents the change of the pulverizing media weight. As S(the less the inner sleeve), the greater the volume of the pulverizing chamber would become. Accordingly, the weight of the pulverizing media was increased. As a result, the mill power consumption was increased in accordance with the increase of S/R as indicated by the curve II. Also, the reason why the power was abruptly increased at the ratio S/R of 0.1 was that S=250 mm×0.1=25 mm, i.e., S/d=25 mm/10 mm=2.5 was established out of the above-described suitable condition of S/d≧3.

On the other hand, the curve III shows the pulverizing power source unit ratio (power consumption per one ton in case of pulverizing for the same particle size). It is understood from the curve that the range where the pulverization is possible with the least power is 0.12≦S/R≦0.5. In the case of S=0.12, since S=250 mm×0.12 =30 mm, S/d=30 mm/10 mm=3. Accordingly, in the case of S/R<0.12, it should be understood that the above-described optimum condition of S/d≧3 is not met. The reason why the power source unit is increased in case of S/R>0.5 is that the increasing rate of the pulverizing processing ability is small relative to the increasing rate of the power indicated by the curve II.

Figure 11A:
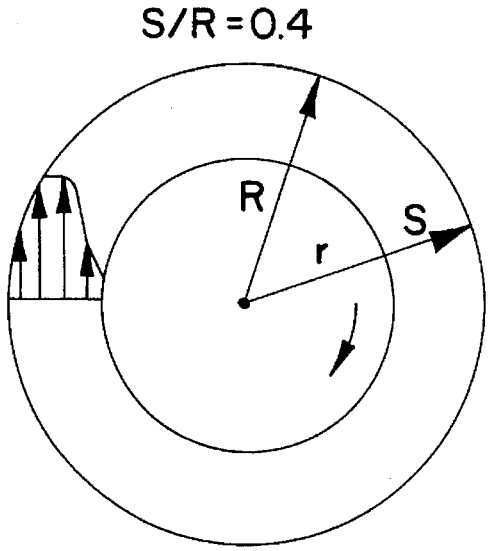
FIG. 11 is a graph showing a relation between the dimensional ratio of the inner and outer sleeves and the rotational speed of the pulverizing media.
Figure 11B:
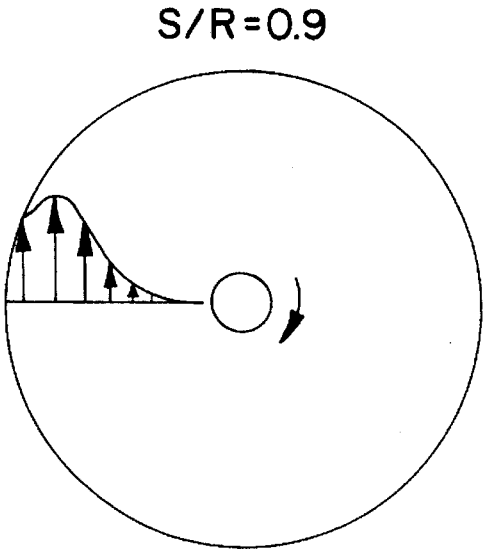

It is assumed that the reason why the pulverizing processing ability is small in the case where S/R is large is that, as shown by the rate gradient curve in FIG. 11(*b*), the rotational speed of the pulverizing media in the vicinity of the inner sleeve is very small and the rotational speed has almost no function to contribute to the pulverization. In contrast, according to the present invention, since r/R≧0.5 (S/R<0.5), as indicated in FIG. 11(*a*), only the outer annular portion which has a high rotational speed for the pulverizing media and which is suitable for the pulverization is used as the pulverizing chamber. Accordingly, it is possible to attain the high efficiency pulverization with a low power source unit.

Continuous Pulverizing Test

Figure 12A:
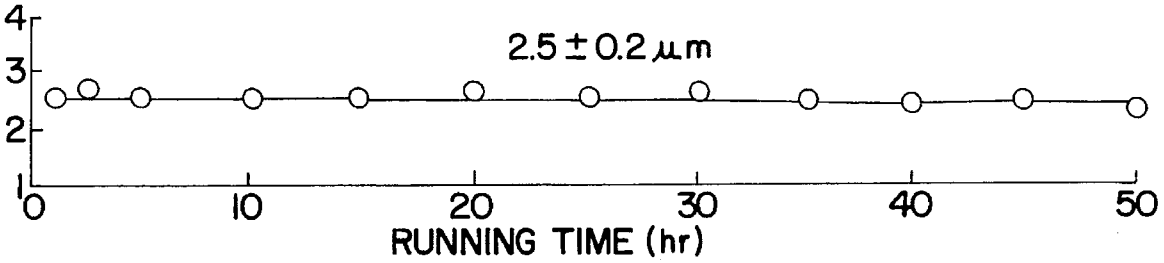
FIG. 12 is a view exemplifying the experimental result of the continuous pulverization of calcium carbonate.
Figure 12B:
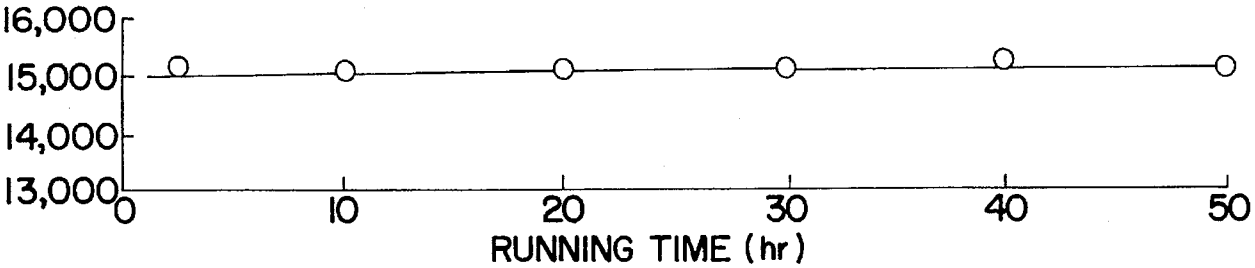
Figure 12C:
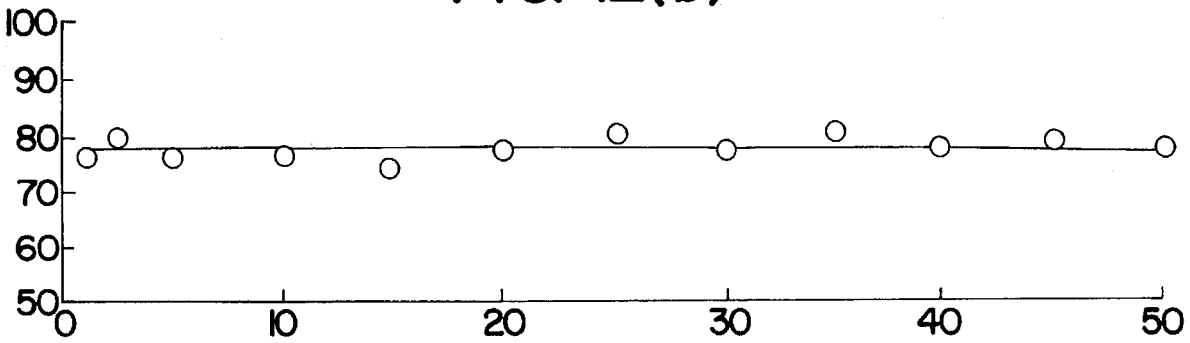

FIG. 12 shows a continuous pulverization result with calcium carbonate under the condition of the ranges specified according to the method of the present invention, i.e., A=1.5 G, d=10 mm, S/R=0.4, S/d=10, and P/d=10 for 50 hrs. From FIG. 12, it is understood that the very stable continuous pulverization characteristics may be attained according to the method of the invention.

The following effects may be obtained according to the pulverizing method and the pulverizing mill of the invention.

1) Since the temperature elevation of the pulverized material within the mill is small in case of the upgraded capacity, it is possible to obtain a large capacity mill.

Figure 13:
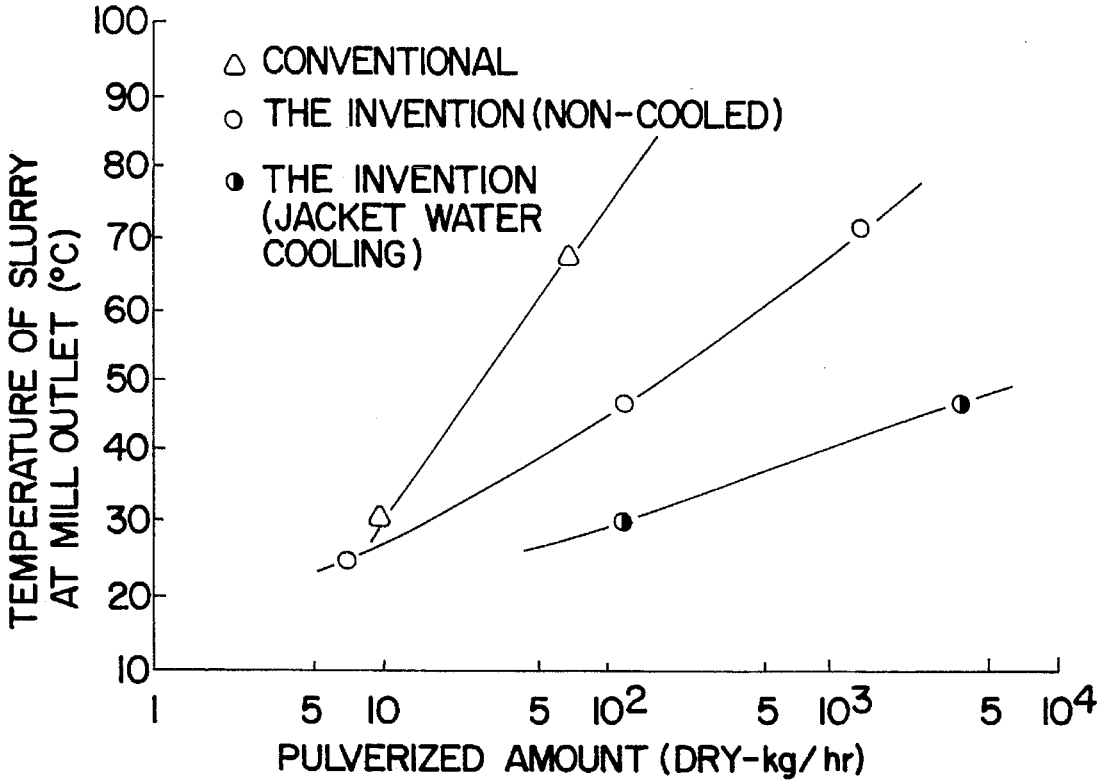
FIG. 13 is a view exemplifying the experimental result in comparison with the mill outlet temperature when the silica stone is wet pulverized.

This is based upon the fact that the large cooling area of the inner sleeve may be kept by using the large diameter inner sleeve, the filling amount is reduced even if the filling rate of the pulverizing media is kept constant, and further the pulverizing power is reduced by optimizing the interval S between the inner and outer sleeves and the axial interval P of the agitating vanes. FIG. 13 shows a test result of the mill outlet slurry temperature when the silica stone was pulverized according to the wet milling method of the invention in comparison with the conventional method. It is understood that the present invention is suitably applicable to the large capacity system. Actually, the 4t/h silica stone ultra-fine pulverizing mill which is said to be the largest in the world is well operated.

2) A mechanochemical effect may readily be found out in the pulverization.

This effect is based upon the fact that the pulverizing media having a large diameter of from 5 to 15 mm is used. The "mechanochemistry" means a phenomenon in which mechanical energy is applied to a solid material by the pulverizing effect so that a lattice defect is increased, the size of crystalline particles is reduced, and an amorphous property is generated. At this time, in many cases, a reaction property, adsorption, catalyst activity or the like is considerably enhanced. Recently, by utilizing these characteristics, the additional value and quality of the pulverized material have been enhanced.

Figure 14:
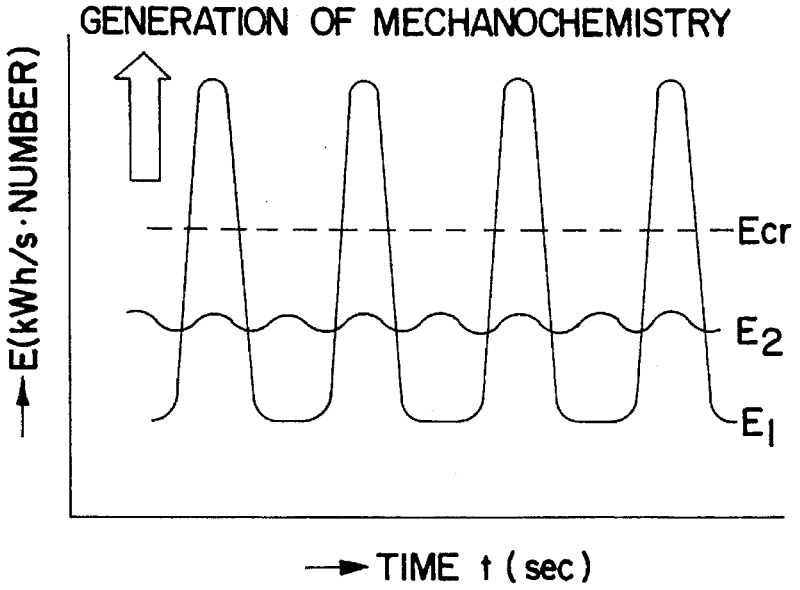
FIG. 14 is a view exemplifying the experimental result of generation of the mechanochemistry of an iron system catalyst.
Figure 15:
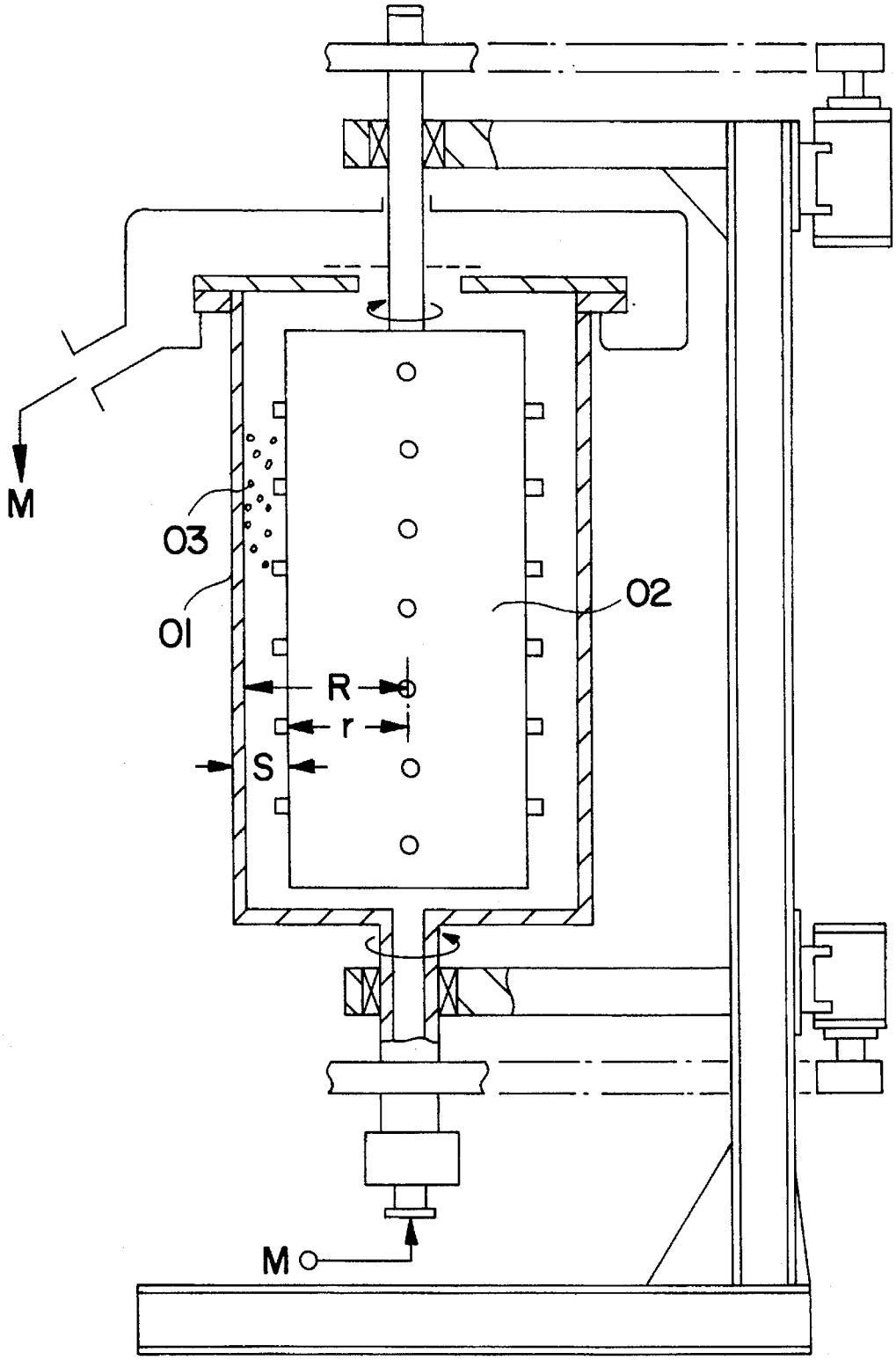
FIG. 15 (PRIOR ART)
FIG. 15 is a longitudinal sectional view showing an example of a conventional mill.

FIG. 14 shows an experimental result of the mechanochemistry of the iron system catalyst. It has been found that even if the same energy (Ext) is applied, the mechanochemistry does not occur in the small size media mill (indicated by $E_2$ in FIG. 14) and the mechanochemistry occurs only in the large size media mill ( indicated by $E_1$ in FIG. 14) having the media diameter of 5 to 15 mm. The reason for determining the mechanochemistry would be that the mechanochemistry occurs only under the conditions that the critical energy $E_{cr}$ is present and the instantaneous energy E to be given from the pulverizing media to the pulverized material is larger than $E_{cr}$. Namely, the mechanochemistry is more readily generated in the case where a large amount of energy is given by the large size media even if the number of the media is small, than in the case where a large amount of energy is given by the small media.

3) As described above, the present invention is based upon the opposite concept to the conventional prerequisite theory that the small media and high rotational speeds are preferable for the ultra-fine pulverization. According to the invention, the large media and the low rotational speed are used. As a result, the present invention may be practically applied to a high capacity ultra-super pulverizing mill of 4t/h to which the conventional method would be applied with difficulty and the present invention may be successfully applied to a highly additional valuable powder structure by the mechanochemistry.

What we claim is:

1. A pulverizing method comprising the steps of:

1) charging material to a space containing pulverizing media having a diameter of 5 to 15 mm, said space being defined by an inner surface of an outer horizontal hollow cylinder and an outer surface of an inner cylinder, wherein the ratio of an outer diameter of said inner cylinder to an inner diameter of said outer cylinder is not less than 0.5, said cylinders being positioned such that the difference between the outer diameter of said inner cylinder and the inner diameter of said outer cylinder is not less than three times the diameter of said pulverizing media, said inner surface of said outer cylinder having a plurality of agitating vanes mounted thereon and said outer surface of said inner cylinder having a plurality of agitating vanes mounted thereon, said vanes of said inner and outer cylinders being spaced at axial intervals of three to sixty times the diameter of said pulverizing media;

2) rotating at least one of said inner and outer cylinders at a rotational speed such that the maximum acceleration applied to said pulverizing media does not exceed three times the gravitational acceleration to pulverize the material; and 3) delivering ultra-fine pulverized material from a discharge outlet at an end portion of said outer cylinder.

2. A horizontal mill comprising:

a substantially horizontal outer hollow cylinder having an inner surface;

an inner cylinder having an outer surface and being mounted coaxially within said outer cylinder, wherein said outer surface of said inner cylinder and said inner surface of said outer cylinder define a space forming an annulus in cross section and wherein a ratio of an outer diameter of said inner cylinder to an inner diameter of said outer cylinder is not less than 0.5;

pulverizing media provided in said space, said pulverizing media having a diameter in the range of 5 to 15 mm, wherein a distance between said inner surface of said outer cylinder and said outer surface of said inner cylinder is not less than three times the diameter of said pulverizing media;

a plurality of agitating vanes mounted on said inner surface of said outer cylinder;

a plurality of agitating vanes mounted on said outer surface of said inner cylinder, wherein an axial distance between adjacent agitating vanes of said inner and outer cylinders is in a range of three to sixty times the diameter of said pulverizing media; and means for rotating at least one of said outer cylinder and said inner cylinder.

* * * * *